US007883033B2

(12) United States Patent
Lind

(10) Patent No.: US 7,883,033 B2
(45) **Date of Patent: *Feb. 8, 2011**

(54) LEAD SCREW LOCKING DEVICE

(75) Inventor: James Lind, Lenexa, KS (US)

(73) Assignee: Battelle Memorial Institute, Columbus, OH (US)

( * ) Notice: Subject to any disclaimer, the term of this patent is extended or adjusted under 35 U.S.C. 154(b) by 159 days.

This patent is subject to a terminal disclaimer.

(21) Appl. No.: 12/001,751

(22) Filed: Dec. 10, 2007

(65) Prior Publication Data

US 2009/0145986 A1 Jun. 11, 2009

(51) Int. Cl.
*B05B 5/00* (2006.01)
*F23D 11/32* (2006.01)

(52) U.S. Cl. ..... 239/690; 239/690.1; 239/692; 239/704; 239/708; 222/390

(58) Field of Classification Search ..... 239/242, 239/690, 690.1, 704, 708; 222/390, 391, 222/613

See application file for complete search history.

(56) References Cited

U.S. PATENT DOCUMENTS

| | | | | |
|---|---|---|---|---|
| 4,335,834 | A * | 6/1982 | Zepkin | 222/63 |
| 5,033,678 | A * | 7/1991 | Borghese et al. | 239/242 |
| 5,819,980 | A | 10/1998 | Hill | |
| 5,820,602 | A * | 10/1998 | Kovelman et al. | 604/187 |
| 5,938,642 | A * | 8/1999 | Burroughs et al. | 604/208 |
| 6,022,163 | A * | 2/2000 | Asfur | 401/175 |
| 6,311,903 | B1 * | 11/2001 | Gaw et al. | 239/690 |
| 2004/0021017 | A1 | 2/2004 | Sumiyoshi et al. | |

FOREIGN PATENT DOCUMENTS

| | | | |
|---|---|---|---|
| GB | 2256679 | A | 12/1992 |
| WO | 0112335 | A1 | 2/2001 |
| WO | 2007002477 | A2 | 1/2007 |
| WO | 2007145644 | A1 | 12/2007 |
| WO | 2008002556 | A1 | 3/2008 |

OTHER PUBLICATIONS

Frego, Maria Chiara; European Search Report; Application No. EP 08 17 0873; European Patent Office; Munich, Germany; Mar. 24, 2009.

* cited by examiner

*Primary Examiner*—Dinh Q Nguyen
(74) *Attorney, Agent, or Firm*—Stevens & Showalter LLP

(57) ABSTRACT

A cartridge for an electrohydrodynamic spraying device and a spraying device incorporating the cartridge, where the cartridge includes a locking mechanism. The cartridge is disposable, and can contain therapeutic or other fluid products. The fluid is delivered from the cartridge by a shaft-mounted piston, while the locking mechanism can be selectively engaged with the shaft such that in the engaged position, the locking mechanism prevents the piston from advancing by inhibiting movement of the shaft. When the locking mechanism is disengaged from the shaft, the shaft and piston are free to move, such as in response to a power source in the spraying device. The selective engagement between the locking mechanism and the shaft during periods of inoperability of the spray device prevents the buildup of fluid pressure in the cartridge that otherwise could blurt out upon subsequent operation.

14 Claims, 9 Drawing Sheets

LEAD SCREW LOCKING DEVICE

BACKGROUND OF THE INVENTION

The present invention relates generally to spraying finely dispersed liquids contained in a cartridge used in a handheld spraying device, and more particularly to a device and method for locking the cartridge during periods of non-use to avoid leakage therefrom.

Spraying using electrohydrodynamic (EHD) technology (also referred to as electric field effect technology (EFET)) is a process where fluids or other bulk solutions are dispensed through electrically-charged nozzles. In an EHD spray nozzle, the material to be sprayed flows through a region of high electric field strength made possible by the application of a high voltage to the nozzles and associated nozzle geometry. The high voltage causes the fluid material to acquire an electric charge; the electric field present at the nozzle tips applies a pole to the fluid; the poled fluid charge induces a force that acts in opposition to the surface tension of the material. This surface charge causes the formation of at least one ligament of thin jet of material, causing comminution of the fluid into fine droplets.

In one embodiment, EHD spraying devices are incorporated into hand-held sprayers, where additional flexibility can be built in through the use of disposable cartridges. This is beneficial in situations where prolonged or excessive exposure to the fluid being dispensed is undesirable, such as with pesticides or other materials used to treat horses and other domesticated animals. Disposable cartridges typically define a cylindrical fluid storage compartment and include a complementary-shaped piston threadably mounted onto a lead screw, where the piston is driven along the length of the compartment upon rotation of the lead screw. The extension of the lead screw into the compartment causes it to contact the fluid to be dispensed; such a configuration is known as a wetted lead screw. The compartment defines a fluid path with a discharge orifice (or outlet) so that fluid disposed between the piston and the discharge orifice is pumped through the orifice in response to the increasing pressure caused by piston movement toward the orifice.

To reduce the amount of fluid that could leak out between uses, a valve, plug or related flow control mechanism can be placed at or near the discharge orifice to allow the user to shut off the fluid flow. Such an approach works well if the user remembers to open the flow control mechanism before each use; however, if the user should forget to open the flow control mechanism before turning on the pump, pressure will build inside the cartridge that, upon opening the flow control mechanism, would cause the fluid to burst out in an uncontrolled manner, known as a "blurt".

One method to mitigate blurting would be to use sensors or some other feedback means to prevent the lead screw from being turned when the flow control mechanism is closed. Such remedies are unavailing in cost sensitive cartridge designs. What is desired is a simple, inexpensive way to lock the cartridge. What is further desired is such a way to provide a locking mechanism that can be used on a disposable cartridge.

BRIEF SUMMARY OF THE INVENTION

These desires are met by the present invention, wherein a device and a method of dispensing a fluid are disclosed. In accordance with a first aspect of the present invention, a fluid dispensing cartridge for use with an electrohydrodynamic spray device is disclosed. The cartridge includes a body with a fluid chamber and discharge aperture formed in the chamber. A rotatable shaft is placed in the fluid chamber, and a piston is threaded onto the shaft so that rotation of the shaft causes the piston to advance, thereby forcing at least a portion of a fluid disposed in the fluid chamber to pass from the chamber and through the discharge aperture. To keep the cartridge from being inadvertently discharged when not in use, as well as to avoid pressure build-ups in the fluid chamber or discharge aperture that could result from the shaft and piston continuing to pump fluid, a locking mechanism is included. The locking mechanism selectively engages the shaft such that in a first position (which may occur, for example, when the spray device is turned off), the locking mechanism engages the shaft to inhibit its rotation, while in a second position (which may occur, for example, when the spray device is being used to dispense the liquid) the locking mechanism disengages from the shaft, thereby permitting shaft rotation.

Optionally, the shaft is a lead screw, and more particularly a wetted lead screw. The cooperation between the locking mechanism and the shaft is preferably through a rotatable gear formed on one of the locking mechanism and the shaft, where individual teeth formed on the radial periphery of the gear selectively engage a complementary-shaped detent that is separately mounted. In this way, in a first position, the detent interferes with the rotation of the gear by having the detent situated between the teeth, while in the second position, the detent is moved away from the teeth so that it does not interfere with the gear to effect the permitted rotation. The locking mechanism may additionally include a hand-grippable knob. In one form, this knob is placed at one end of the cartridge, and can be made to turn (for example, by rotation) to place the detent in one of the first or second positions. In a more particular form, the cartridge defines a substantially cylindrical profile, and has a proximal end where the shaft can engage the spray device and a distal end where the knob can be placed. In a more particular form, the profile is an elongate cylinder such that the elongate axis extends substantially longitudinally. The knob can be made such that the movement of the knob is rotational about the longitudinal axis of the cartridge. In one particular example, the shaft and knob may each be rotated about axes that are parallel to and laterally offset from one another. In this way, movement of the detent is eccentric relative to movement of the gear that is mounted to or formed on the shaft. In a particular arrangement of the locking mechanism, the gear is disposed at the distal end of the shaft, while the detent is part of a rotational member that has at least a portion of its movement decoupled from the shaft. In one form, a non-axisymmetric socket or related recess can be formed in the distal end of the shaft such that the gear with the toothed profile extends axially from the distal shaft end. The teeth of the gear and the detent ensure that when engaged, the shaft and knob are coupled so that shaft rotation is prevented. In one form, the teeth making up the gear define rounded (rather than squared-off) end profiles.

In one particular form, the detent is made up of at least one finger. The one or more fingers are situated on a rotatable member (for example, a plate, disc or related member that can be oriented such that a longitudinal axis of the shaft is oriented normal to that plate's major surface. In this way, the finger, which is mounted to and extends radially outward from a periphery of the plate, can be rotated into engagement with the teeth of the shaft. In other words, upon rotation of the plate or related member, the detent or finger travels along an arcuate gear engagement path defined by the radial outer bounds of the plate. Thus, the teeth in the first position prevent rotation of the gear, and in the second position do not fit between adjacent the teeth, thereby allowing rotation of the gear. A stopcock may also be included. It may be sized to fit within a volume defined by the knob, and may further be integrated with parts of the locking mechanism (such as the rotatable member discussed above) so that such components are formed on the stopcock. The stopcock includes a fluid passageway to convey the fluid that is placed ion the cartridge between the cartridge and the spray device. In another option, various components can be formed from a plastic material. Specific components, such as the shaft, may be made from particular materials, such as nylon, whether reinforced or not. To decrease wobble, it may be useful to secure the shaft at both its proximal and distal ends. The ends of the shaft, as they come in close proximity to, or even penetrate through the end walls of the cartridge, may be supported by a race, boss, bearing, trough or related device formed into, extending from or otherwise cooperative with the walls. At the distal end of the cartridge, an axial connection (such as those examples just mentioned) between the shaft and the locking mechanism could provide the necessary support. In a particular form, the arcuate gear engagement path that is formed on the rotational member defines a cammed profile that stays in substantial contact with a peripheral dimension formed by the teeth. In such case, the detent extends in a radially outward direction from the cammed profile such that rotational movement between the arcuate gear engagement path and the gear moves the finger into one of the first and second positions.

According to another aspect of the invention, an EHD spray device is disclosed. The device includes a fluid dispensing cartridge with a fluid chamber that can contain a fluid. The fluid chamber has a proximal end and a distal end substantially opposite one another. A lead screw is placed within the fluid chamber, while a piston is coupled to the lead screw such that upon rotation of the lead screw, the piston advances toward the distal end to force at least a portion of the fluid out of the cartridge. A locking mechanism can be made to selectively couple to the lead screw such that in a first position, the locking mechanism engages the lead screw to inhibit screw rotation, while in a second position, the locking mechanism disengages the lead screw to permit the screw to rotate. A handle can releasably receive the cartridge; in this way, the cartridge may be configured for one-time (i.e., disposable) use. The handle houses numerous components, including a rotational power source (such as a motor and shaft coupling responsive to the motor), a high voltage electrical source, a switch to turn the spray device on and off, a spray manifold and a plurality of nozzles. Fluid communication is established between the spray manifold, nozzles and cartridge. In addition, one or more of the manifold and the nozzles are in electrically coupled with the high voltage electrical source such that upon operation of the spray device, a voltage is applied to force comminution of the fluid being discharged from the nozzles.

Optionally, the locking mechanism includes a hand-turnable knob and a detent member cooperative with the knob, where the knob moves about a first axis of rotation. In addition, a gear is disposed on the lead screw such that the gear and the lead screw define a second axis of rotation that is substantially parallel to and laterally offset from the first axis of rotation. In this way, upon rotational movement of the knob, the detent member selectively engages or disengages the gear. In another option, the spray device further includes a stopcock fluidly disposed between the fluid chamber and the spray manifold such that it can help convey the fluid from the cartridge to the nozzles. The detent member may be formed on the stopcock such that both are rotationally cooperative with the knob. In addition, the engagement of the detent member with the gear can be made to occur when the spray device is turned off. Contrarily, the disengagement of the detent member from the gear can be made to occur when the spray device is turned on. Thus, when the knob is turned to lock the detent and the gear together, the lead screw and piston are disabled from pumping liquid; this prevents a buildup of pressure within the cartridge that might otherwise cause blurting once operation of the spray device commences.

According to yet another aspect of the present invention, a method of operating an EHD fluid sprayer is disclosed. The method includes configuring a sprayer to have a handle and a cartridge that is removably attachable to the handle. As discussed in the previous aspect, the handle includes a rotational power source, high voltage electrical source, switch, spray manifold and nozzles in fluid communication with the spray manifold. The method further includes disposing a fluid within a cartridge, and having the handle be in fluid communication with the spray manifold. The cartridge includes a fluid chamber, lead screw, piston and locking mechanism cooperative with the lead screw such that in a first position, the locking mechanism engages the lead screw to inhibit screw rotation, while in a second position, the locking mechanism disengages the lead screw to permit screw rotation. The method further includes connecting the cartridge to the handle and the spray manifold. During a period when the fluid is to be dispensed from the spray device, the method further includes rotationally moving the lead screw to advance the piston while the locking mechanism is disengaged from the lead screw, while during a period when the fluid is to not be dispensed from the spray device, engaging the locking mechanism and the lead screw so that the lead screw does not rotate.

Optionally, the method includes moving a detent that is formed as part of the locking mechanism into an interference fit with a gear that is coupled to the lead screw to establish the first (locked) position. Establishing the second (unlocked) position includes moving the detent out of the interference fit with the gear. Such moving the detent comprises rotationally turning a knob that is coupled to the detent.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1:
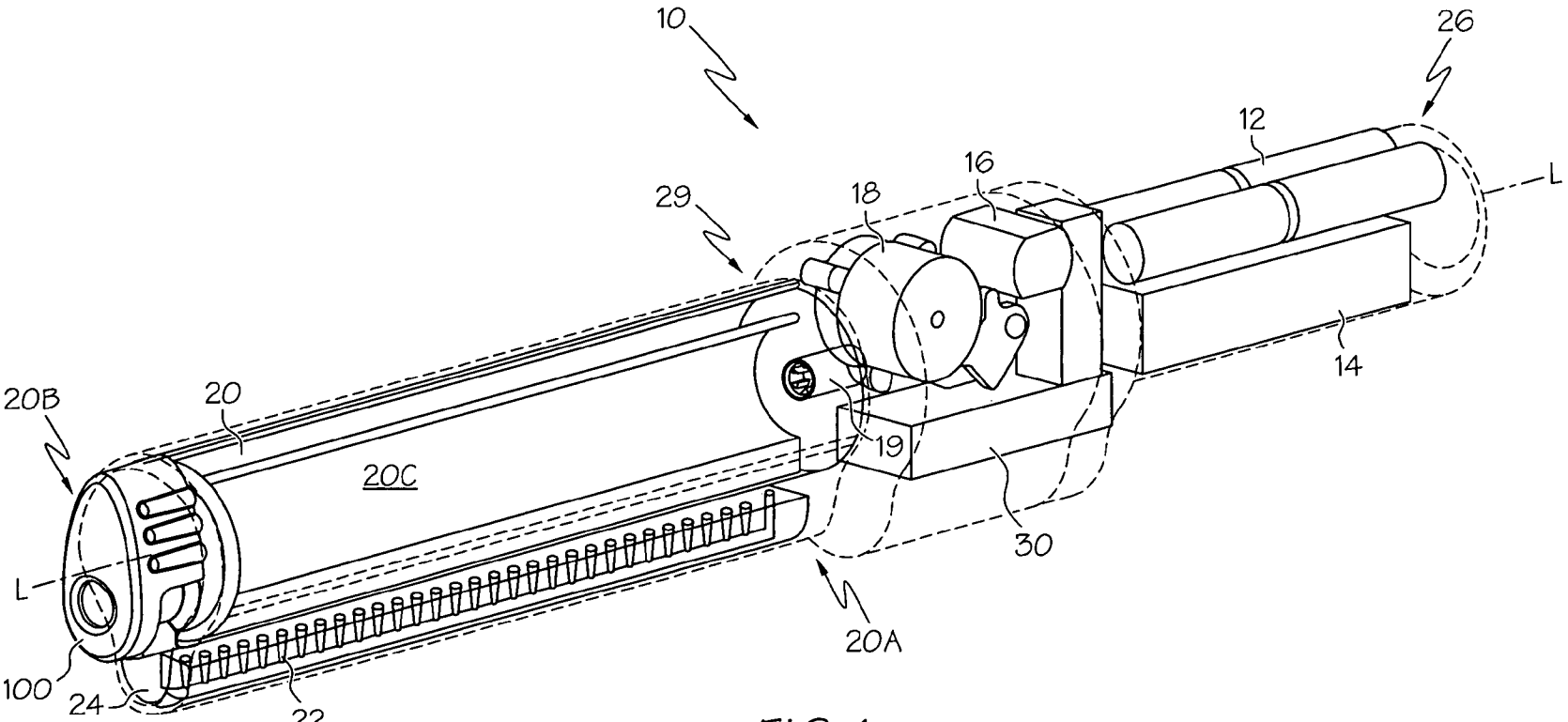
FIG. 1 shows a cartridge according to an aspect of the present invention, and connection of the cartridge to an EHD spray device.

Referring first to FIG. 1, a sprayer (also called a spray device) 10 includes a fluid-containing cartridge 20, handle 26 and a cartridge interface 29. The cartridge 20 and the cartridge interface 29 are adapted to enable the cartridge 20 to attach and detach quickly, easily, and without spillage of contained liquid. An array of nozzles 22 are situated beneath cartridge 20, and are in fluid communication therewith to dispense a fluid. The handle 26 is used to house a power supply 12, a converter (also referred to as an electronics or circuit board) 14, a motor 16, a drive mechanism 18 and driver 19, and a high voltage multiplier 30 (also referred to as a voltage multiplier circuit). In the present context, the term "high voltage" and its variants is used to represent increases in voltage over that provided by the power supply 12 due to the operation of the voltage multiplier 30, rather than as indicia of a particular voltage level. By way of example, for a voltage measured at the output of the power supply 12 of six volts, a voltage of thousands of volts measured at the output of the voltage multiplier 30 would constitute a high voltage. The power supply 12 may comprise a portable, on-board voltage supply, such as through a set of batteries, for example four AA batteries, which may or may not be rechargeable. Converter 14 includes a processor, transformer and potting material (none of which are shown, and the last of which to encase the multiplier 30 to provide insulation for the high voltage emanating therefrom). The converter 14 acts to step up the voltage from the power supply 12 to a higher level in order that it may (among other things) power the multiplier 30. The multiplier 30, in turn, converts the voltage from the converter 14 to a level suitable for comminuting a liquid contained within the cartridge 20 with EHD forces. The multiplier 30 may be configured as a flyback oscillator circuit as understood by those skilled in the art. In an exemplary form, converter 14 (with transformer 17 and multiplier 30) can take an input voltage of between four and six DC volts and convert that to between twenty thousand and thirty thousand DC volts. An electrical connection (not shown) between the multiplier 30 and the nozzles 22 enables a necessary charge to be formed on the latter such that when fluid passes therethrough, it is comminuted. In alternative configurations where the cartridge 20 is not detachable from the handle 26, the handle 26 may include any combination of the power supply, fluid reservoir, pump, controller/processor or related componentry.

For EHD spraying, the pressure necessary to move the fluid is nominal. Enough is needed to continuously provide fluid to replace that which is dispensed at what are referred to as Taylor cones formed at the nozzles 22. The nozzles 22 are preferably fixed to the cartridge 20, promoting ease of use as they may be disposed of or reusable together. Alternatively, the nozzles 22 may be separable and reusable from the cartridge 20. The nozzles 22 are preferably electrically connected to a high voltage source within the sprayer 10, as can the manifold 90. In either way, the EHD sprayer 10 can impart the necessary charge to the droplets of liquid that are discharged from the nozzles 22. The nozzles 22, manifold 90 (shown in FIG. 3) or both can be made of a conductive plastic material, using as base materials polymers, for example polycarbonate, high density polypropylene, or preferably polypropylene, acrylonitrile-butadiene-styrene (ABS) and high density polyethylene (HDPE), which can be appropriately compounded as known in the art to exhibit conductive properties. Preferably, such materials exhibit surface resistivity from approximately $10^2$ to $10^{14}$ ohm/square, and volume resistivity of $10^2$ to $10^{14}$ ohm/cm. Alternatively, the nozzles 22 may be made of other electrically conductive (for example, metallic) materials that can be cast or otherwise formed into the appropriate geometry.

In another form, the nozzles 22 themselves do not have to be electrically conductive. For instance, they could be non-conductive with a conductive coating on the outside or inside to help establish the proper electric fields. Where the formulation of the fluid is sufficiently conductive, it would be enough that the high voltage contact the fluid somewhere upstream of the nozzles 22. Optionally, the handle 26 includes a grip made from a metal, an electrically conductive material including electrically conductive plastic, electrically conductive polymer, electrically conductive rubber, or combinations thereof. In another option, the remainder of the handle 26 could be made from the same materials as the grip.

There are various ways to establish fluid connection between the fluid chamber of cartridge 20 and the nozzles 22 in such a way as to reduce the likelihood of leakage. In one form, the cartridge 20 includes a septum (not shown) disposed at the distal end 20B. A cap (not shown) may also be disposed at the distal end 20B; the cap cooperative with the septum such that upon engagement of the two, the cap forms the aperture in the distal end and forms the sealing force. In another form, the aforementioned stopcock 101 is disposed at the distal end 20B to allow for repeated opening and closing of the cartridge. In either form, such act as a closure device configured to keep a liquid disposed within the cartridge 20 from exiting through the distal end 20B. As also stated above, the stopcock 101 may also define a continuously open path between the cartridge 20 and the nozzles 22 such that, when the detent 101B and the teeth of gear 41 are engaged, no fluid pressure is applied from piston 50 or shaft 40, so that the sprayer 10 is for all intents and purposes leakage-free.

Figure 2:
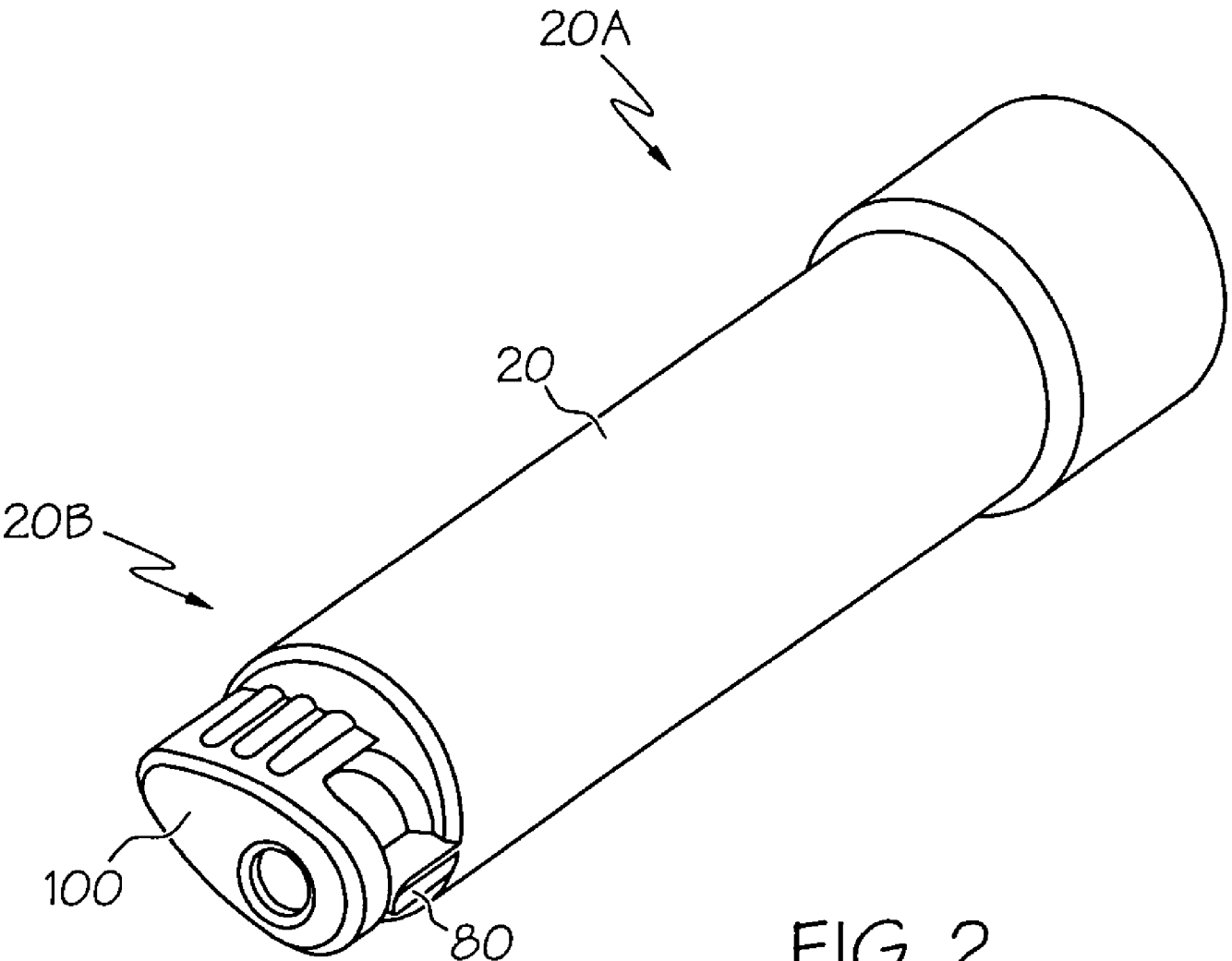
FIG. 2 shows the cartridge of FIG. 1 removed from the EHD spray device with a locking mechanism placed adjacent a distal end of a lead screw used to move fluid through the cartridge.
Figure 3:
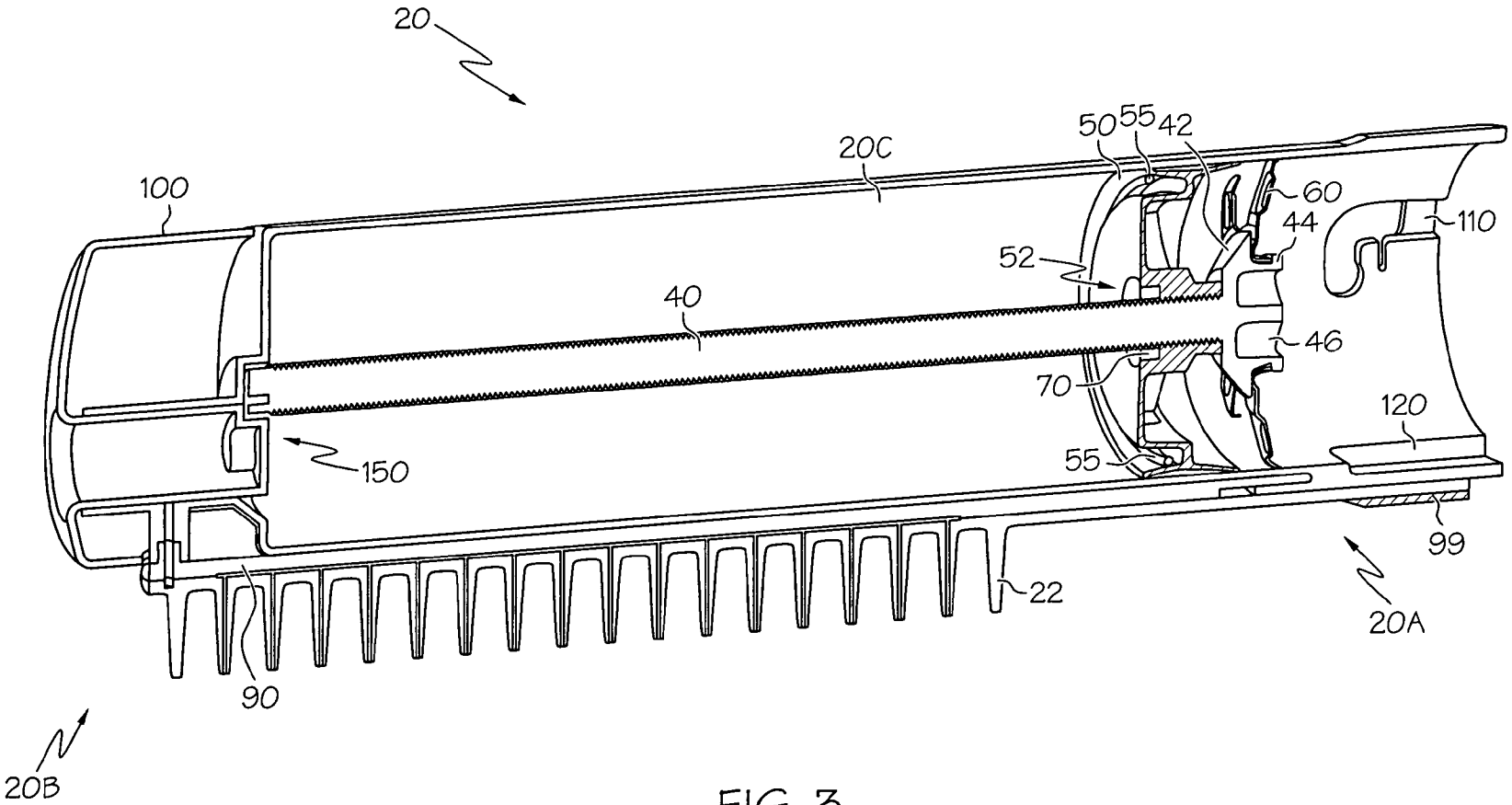
FIG. 3 shows a perspective cutaway view of the cartridge of FIG. 1.

Referring next to FIGS. 2 and 3, a cartridge 20 is shown. In a preferable embodiment, cartridge 20 is disposable and not reusable, such that it is designed for a one-time use. Cartridge 20 includes generally opposing ends: a proximal end 20A that is adjacent to and cooperative with the cartridge interface 29 and driver 19, and a distal end 20B through which the fluid to be dispensed flows, for example, through discharge aperture 80. The interior 20C of cartridge 20 is shown with particularity in FIG. 3, and defines a fluid chamber between the proximal and distal ends 20A, 20B. A perspective cutaway view of the cartridge 20 removed from the sprayer 10 shows that the body of cartridge 20 defines a generally elongate cylindrical shape. In the present context, a cartridge is considered to be generally cylindrical when it includes cylindrical fluid reservoir; it does not require a precisely cylindrical cross-sectional profile. For example, if the cartridge exhibits a slightly prolate, oblate or egg-shaped cross-section, it would still be considered to exhibit generally cylindrical properties as long as it has a substantially cylindrical fluid chamber. Stated another way, the cartridge body may be tubular in shape. In the present context, the term "tubular" refers to a hollow shape which has in cross-section a geometrical or irregular form. The tubular body may be either axially elongate or axially squat, where the former refers to the extension of such form substantially along an axis a distance sufficient to define a fluid chamber, and the latter refers to an axial dimension of the fluid chamber that is relatively small when compared to the radial dimension.

A hand-rotatable knob 100 is placed at the distal end 20B of cartridge 20, and can be used to actuate a locking mechanism 150 that is discussed in more detail below. A discharge aperture 80 can formed in knob 100 and used to route fluid that exits the cartridge 20. In one form, a conduit formed to establish fluid communication between the discharge aperture 80 and cartridge 20 may be permanently opened, such that no valve or related flow shut off componentry is needed.

The inside (fluid-containing) portion of cartridge 20 is bounded at its proximal and distal ends 20A, 20B by a piston 50 and an end wall 24, and radially by the inner wall 20C such that a fluid chamber is defined. End wall 24 forms a closure barrier at the distal end 20B of cartridge 20, and can be penetrated by a rotatable shaft (more particularly and alternately referred to as a wetted lead screw or lead screw, familiar to those skilled in the art) 40 formed as part of cartridge 20 such penetration may include a seal (not shown) to inhibit leakage. Shaft 40 extends along the longitudinal dimension of cartridge 20 from the proximal end 20A to the distal end 20B, and while the shaft 40 can be made from any suitable structural material, in a preferred embodiment it is made of plastic. Piston 50 is mounted onto shaft 40, where threads on both cooperate with each other such that upon rotation of shaft 40, piston 50 progresses from the proximal end 20A to the distal end 20B. While the direction of travel of the piston 50 towards the distal end 20B as described above is preferred, it is not intended to limit the scope of the invention described herein. As such, it will be appreciated by those skilled in the art that the cartridge 20 may be designed so that the shaft 40 drives the piston 50 from the distal end 20B towards the proximal end 20A of the fluid chamber.

A relatively snug fit between the outer periphery of the piston 50 and the inner wall 20C prevents the piston 50 from sympathetically turning with the shaft 40. It will be understood by those skilled in the art that other anti-rotation features may be employed, such as an axial key and slot arrangement formed in the piston and cartridge inner wall, or by forming the inner wall and piston with complementary oval or other non-axisymmetric shape. While such shapes could cause the cartridge 20 to depart from a truly cylindrical profile, it will be understood that all such configurations are within the scope of the present invention. While it is preferable that the piston not rotate in relation to the inner wall 20C, in some cylindrical applications the piston may rotate slightly in relation to the bore wall, but at a rate slower than the shaft 40. The construction of piston 50 is such that it acts like a plunger in that it pushes fluid situated on its downstream portion out of the fluid chamber of the cartridge 20. Retaining ring 55 may be disposed substantially about the periphery of piston 50 to promote rigidity and shape retention. Cartridge 20 may optionally include a window, or be made of a transparent or translucent material (none of which are shown) to provide a visual dose cue to indicate the volume of fluid or number of doses remaining. Other indicia, such as an auditory application cue (not shown) through timed sounds linked to volume dispensing rate could also be used.

In one form, a bayonet-type attachment 110 may be employed, as well as a keyed slot 120 to ensure proper alignment between the cartridge 20 and the handle 26 of sprayer 10. Such an attachment ensures quick connection and removal. The bayonet-type attachment 110 may be disposed on both sides of cartridge 20, so long as both can be engaged or disengaged simultaneously by relative rotation in one direction or the other between the cartridge 20 and handle 26. Alternatively, a twist-type attachment (not shown) with a positive or friction lock, a spring mounted pin and hole arrangement (not shown), or other means for positively connecting the cartridge to the handle would be suitable. The cartridge 20 and handle 26 are preferably detachable, so that cartridge 20 may, as previously stated, be disposable (or refillable), or so that one cartridge may be exchanged for another having a different fluid. The handle interface 29 thus includes both mechanical and electrical interfaces. Use of the cartridge 20 with the handle 26 of a hand-held EHD spray device, is preferred, but the cartridge 20 may be used with non-hand-held EHD spray devices.

A seal 70 is situated between an axial bore 52 formed in the piston 50 and the threads of shaft 40. As with the piston 50, seal 70 may include threads on its inner bore so that the seal 70 can cooperate with the rotational movement of shaft 40. In order to maximize its sealing feature, seal 70 is preferably made from a softer material than that of the shaft 40 or piston 50. This results in a more compliant form that can better maintain small gaps between the seal 70 and the threads of the shaft 40, thereby reducing the possibility of backwards leakage along the shaft 40. Examples of seal material can be a silicone-based or plastic-based structure. In one form, the seal 70 can be integrally manufactured into piston 50 to ensure a leak-free connection.

A proximal end of shaft 40 fans out to define a hub 42, while at its distal end, shaft 40 preferably has a geared end (also called gear) 41 supported in a race 24A, trough or similar socket (collectively referred to as a race 24A) in end wall 24. In one form, the teeth making up the geared end 41 could be bigger than the diameter of the shaft 40 to have more mass and strength, especially if made as a separate part. In such circumstance, the race 24A would have to be bigger than shown to accommodate the larger diameter teeth. Alternatively, the shaft 40 may be cantilevered, supported at the one end and by the piston 50 and frame 60. To keep shaft 40 radially centered in the fluid chamber and aligned with the driver 19, hub 42 is mounted to a frame 60. Preferably, the frame 60 is made from a relatively rigid material, such as metal. In yet another alternate embodiment, an additional shaft may be used, such that a screw-based auger approach could be employed.

Figure 4:
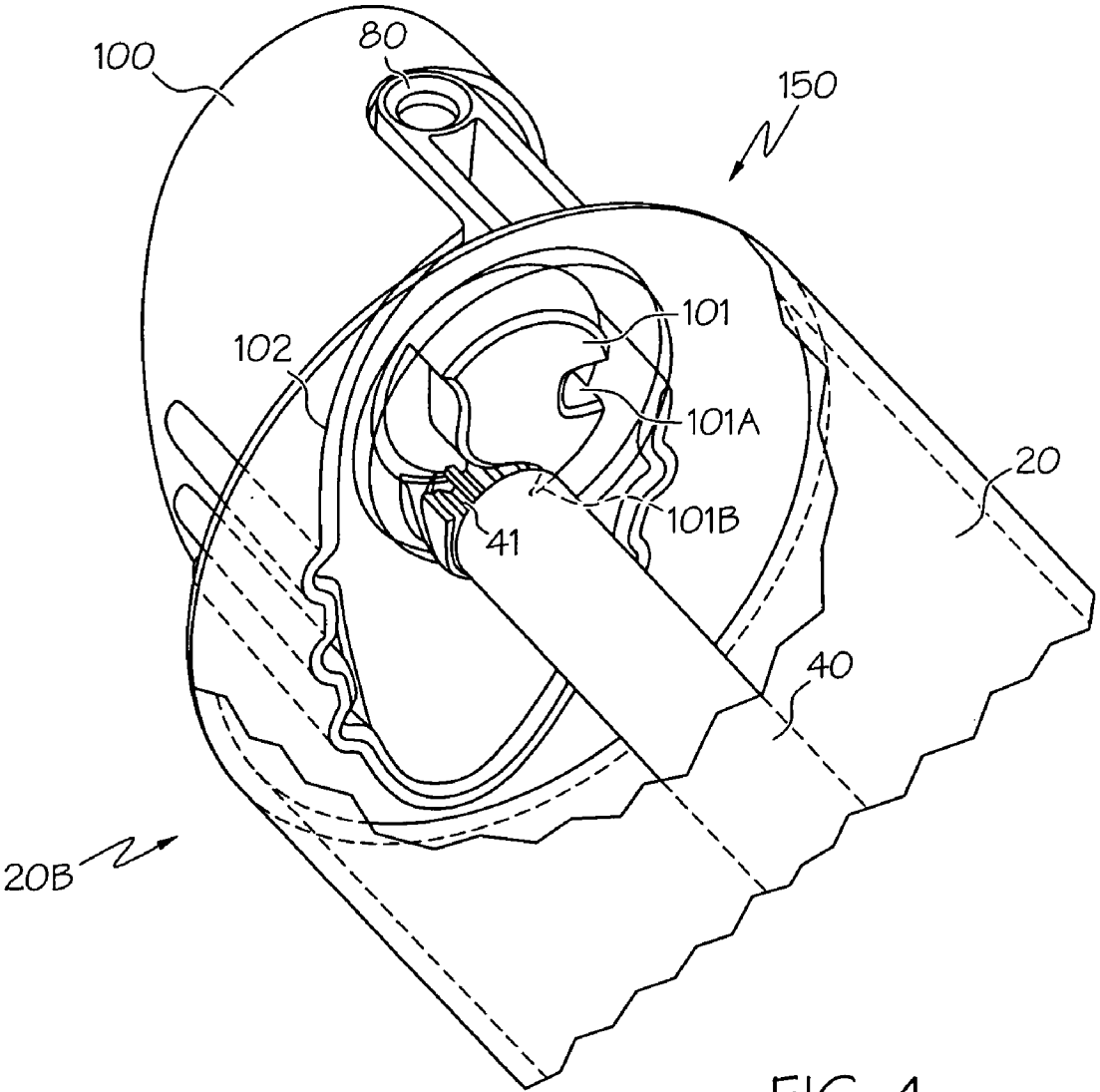
FIG. 4 shows a partially proximal-looking-distal cutaway view of the locking mechanism and its cooperation with the wetted lead screw and a distal end wall of the cartridge of FIG. 2.
Figure 5:
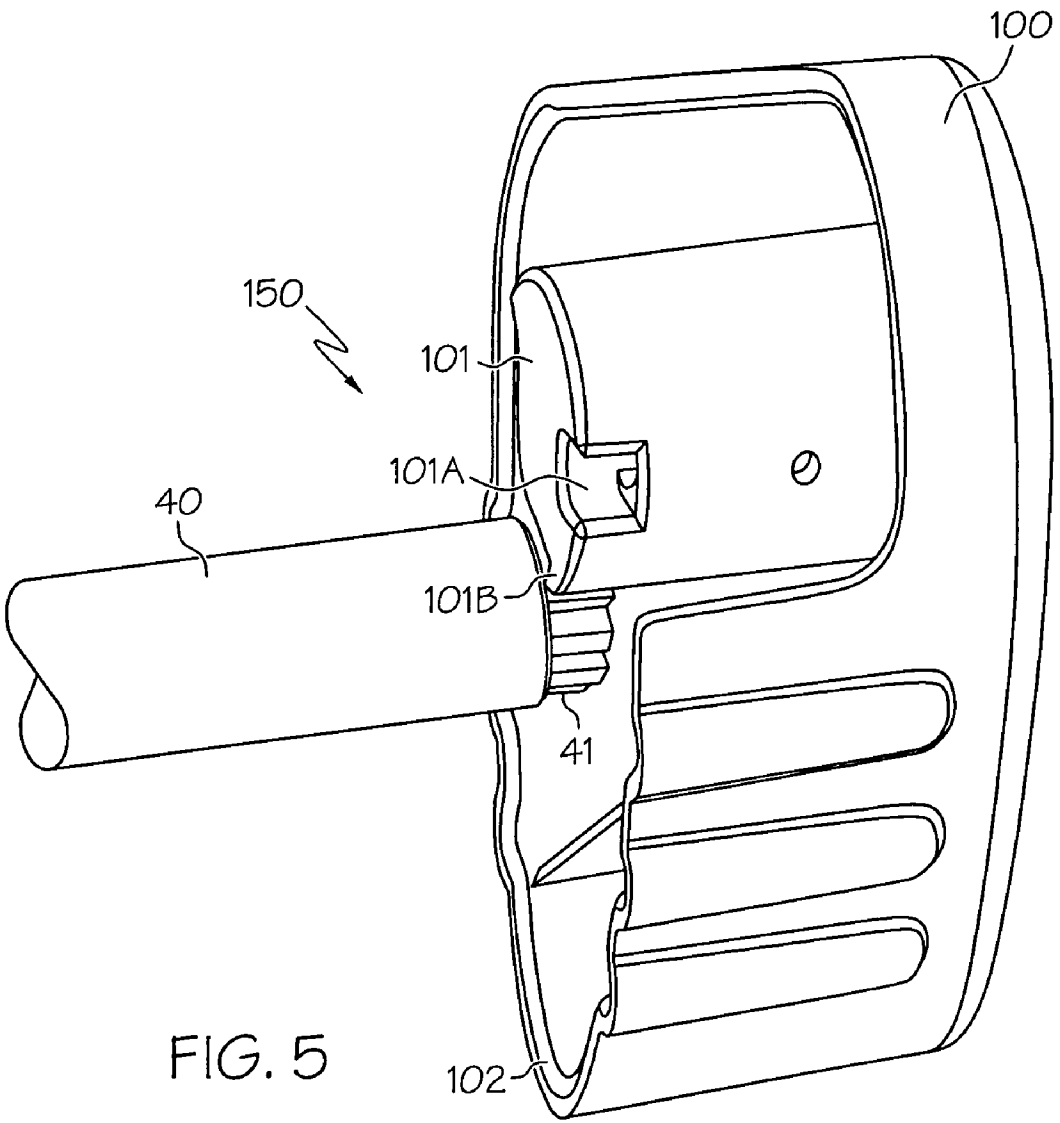
FIG. 5 shows a partial cutaway view of the locking mechanism during a locked position.
Figure 6:
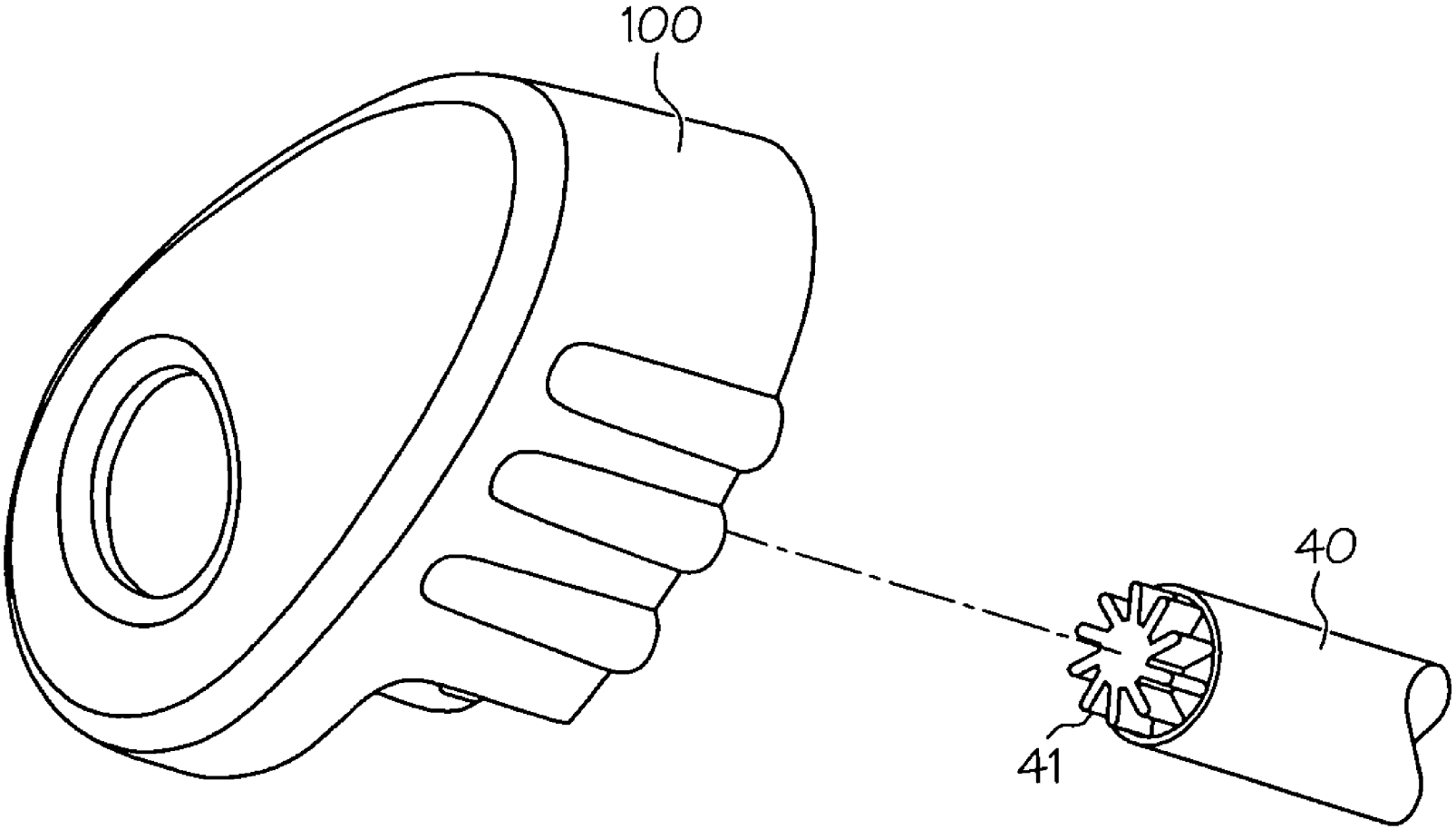
FIG. 6 shows an exploded view of a knob used to selectively engage a locking mechanism with the lead screw.

Referring next to FIGS. 4 through 6, two cutaway assembled views (FIGS. 4 and 5) and one exploded view (FIG. 6) show the connectivity of the shaft 40 and knob 100 as components making up the locking mechanism 150. The locking mechanism 150 additionally includes a stopcock 101 that is affixed to knob 100 through a mounting surface 102 the latter of which could form a structural member or other reinforcement to knob 100. Stopcock 101 acts as a rotatable conduit to ensure fluid communication between the fluid chamber of cartridge 20, the discharge aperture 80 (which may be situated in the wall at the distal end 20B of cartridge 20, or at the end of a conduit or related tube that extends from cartridge 20) and the nozzles 22. Unlike a traditional stopcock, stopcock 101 need not employ a valve to selectively close off flow, as it uses the geared locking mechanism 150 (which is described in more detail below) to achieve the same flow limitation without the danger of a pressure buildup and concomitant startup blurt. Stopcock 101 is axially offset from shaft 40 such that the two do not turn about the same axis of rotation. For example, as shown with particularity in FIG. 5, shaft 40 rotates about an axis of rotation $R_s$, while the knob 100 rotates about an axis of rotation $R_k$ that centers on stopcock 101. Discharge tube 80 can be passed through knob 100 in order to be fluidly coupled to the fluid chamber of cartridge 20 through a passageway 101A in stopcock 101.

Figure 7:
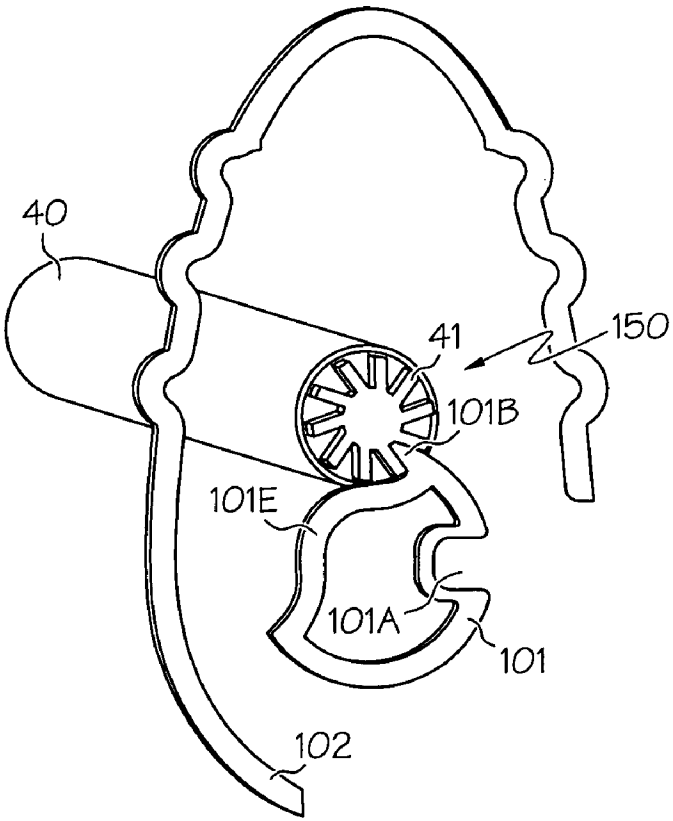
FIG. 7 shows a partial cutaway view of the locking mechanism during a locked position where some components making up the locking mechanism have been removed for clarity.
Figure 8:
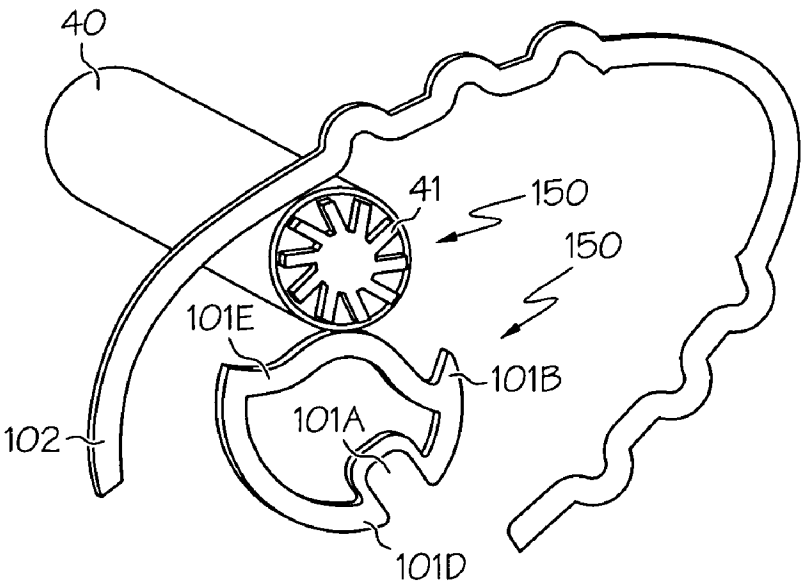
FIG. 8 shows a partial cutaway view of the locking mechanism during an unlocked position where some components making up the locking mechanism have been removed for clarity.

Referring next to FIGS. 7 and 8, the locking mechanism (which may be considered to include the gear 41) includes a mating detent 101B that extends radially outward from stopcock 101 to interfere with the teeth on the gear 41, not allowing it or screw 40 to rotate. As shown, stopcock 101 may form part of the locking mechanism 150, while in other embodiments, may merely provide the necessary fluid passage between the cartridge 20 and nozzles 22. In such case, a plate-like, generally planar rotating member (also called fluid lever), which mimics the functions of a surface of stopcock 101 in a manner generally shown in FIGS. 7 and 8, is used to provide the selectively engageable detent 101B. Specifically, FIG. 7 shows how the teeth of the gear 41 get locked by the detent 101B in the fluid lever. FIG. 8 shows the position just before locking. By having the end profile of the teeth be rounded, the likelihood of detent 101B directly hitting the peak of a tooth is reduced. It will be appreciated that many of the components making up knob 100 and locking mechanism 150 are removed from FIGS. 7 and 8 in order to enhance the clarity of the cooperation between the gear 41 and detent 101B.

Referring next to FIGS. 4 and 5 in conjunction with FIGS. 7 and 8, the particular configuration of the stopcock 101 is shown. In particular, a series of non-axisymmetric features are included so that upon rotation of the knob 100 and stopcock 101, the teeth of geared end 41 of the shaft 40 selectively engage a detent 101B that is situated on the periphery of the stopcock 101. FIG. 7 depicts a locked relationship between the teeth and detent 101B, thereby preventing discharge of fluid from the cartridge 20, whereas FIG. 8 depicts an unlocked relationship between them such that upon activation of the shaft 40 and piston 50, the fluid can be discharged. As can be seen, the detent 101B is parallel to the tangent of the rotating stopcock when positioned near the stopcock. An aperture (not shown) formed in end wall 24 can be positioned in such a way so that it always maintains fluid communication between the passageway 101A and the fluid chamber of cartridge 20. In one configuration, the aperture can be oversized relative to the passageway 101A and define a generally banana-shaped profile in end wall 24 so that regardless of where passageway is situated along an arc defined by rotation of knob 100, it is in communication with the aperture in the end wall 24. In another configuration, the axis of rotation $R_k$ can be centered on passageway 101A rather than on the center of stopcock 101. In this way, the aperture (which now may be of a conventional circular or related shape) formed in end wall 24 is placed in a location so that it always maintain fluid communication between the passageway 101A and the fluid chamber.

In yet another configuration, rotation of the knob 100 relative to the cartridge 20 may selectively establish and cut off fluid access between the passageway 101A and aperture. In such event, the rotational movement acts like a valve, although without the possibility of such valve allowing a pressure build-up in the cartridge 20 and subsequent blurt as discussed in conjunction with the prior art. Such problem is avoided by the rigid mechanical coupling between the knob 100, stopcock 101, shaft 40 and piston 50, as the cooperation among them ensures that the only time the piston 50 can be pumping fluid is during periods where fluid access through discharge aperture 80 through passageway 101A is established. Contrarily, in situations where a sprayer is not being used, stopcock 101 can be engaged to make certain that shaft 40 can't turn (through the engagement of the stopcock 101 with the teeth of the geared end 41 of shaft 40. Referring next to FIGS. 7 and 8, such conditions are shown in the preferred embodiment.

For best operation, the sprayer 10 should be referenced between the user and the target during EHD spraying. The handle 26 preferably comprises a conductive material suitable for making electrical contact between the sprayer 10 and the user. The material may be, for example, a metal, conductive rubber, plastic, or other polymer. The material for the handle 26 may also comprise a soft-touch material to provide tactile contact between the user and the sprayer 10. As shown in the embodiment illustrated in FIG. 1, the power supply 12 may comprise a power supply pack positioned in the front of the handle 26. In an alternate embodiment (not shown), the power supply and associated electronics may be positioned in the rear of handle 26. As discussed above, balance and ergonomic weight distribution is an important consideration for the sprayer 10. In addition to ergonomic considerations, the sprayer 10 may also be designed so that such balance that favors causing the sprayer to strike the ground at the rear (i.e., butt) end of the handle 26 to minimize the potential for damage to the nozzles 22.

Fluid that is forced out of cartridge 20 passes through discharge tube or aperture 80 and into manifold 90, where a series of channels (shown and described in more detail below) distribute the fluid to the nozzles 22. To promote EHD operation, high voltage from handle 26 is imparted to at least one of the manifold 90 and nozzles 22 so that an adjacent charge field to act upon the fluid. An electrical connection 99 is used to establish electrical continuity between the power source 12 and associated voltage multiplying components situated on converter 14.

Figure 9:
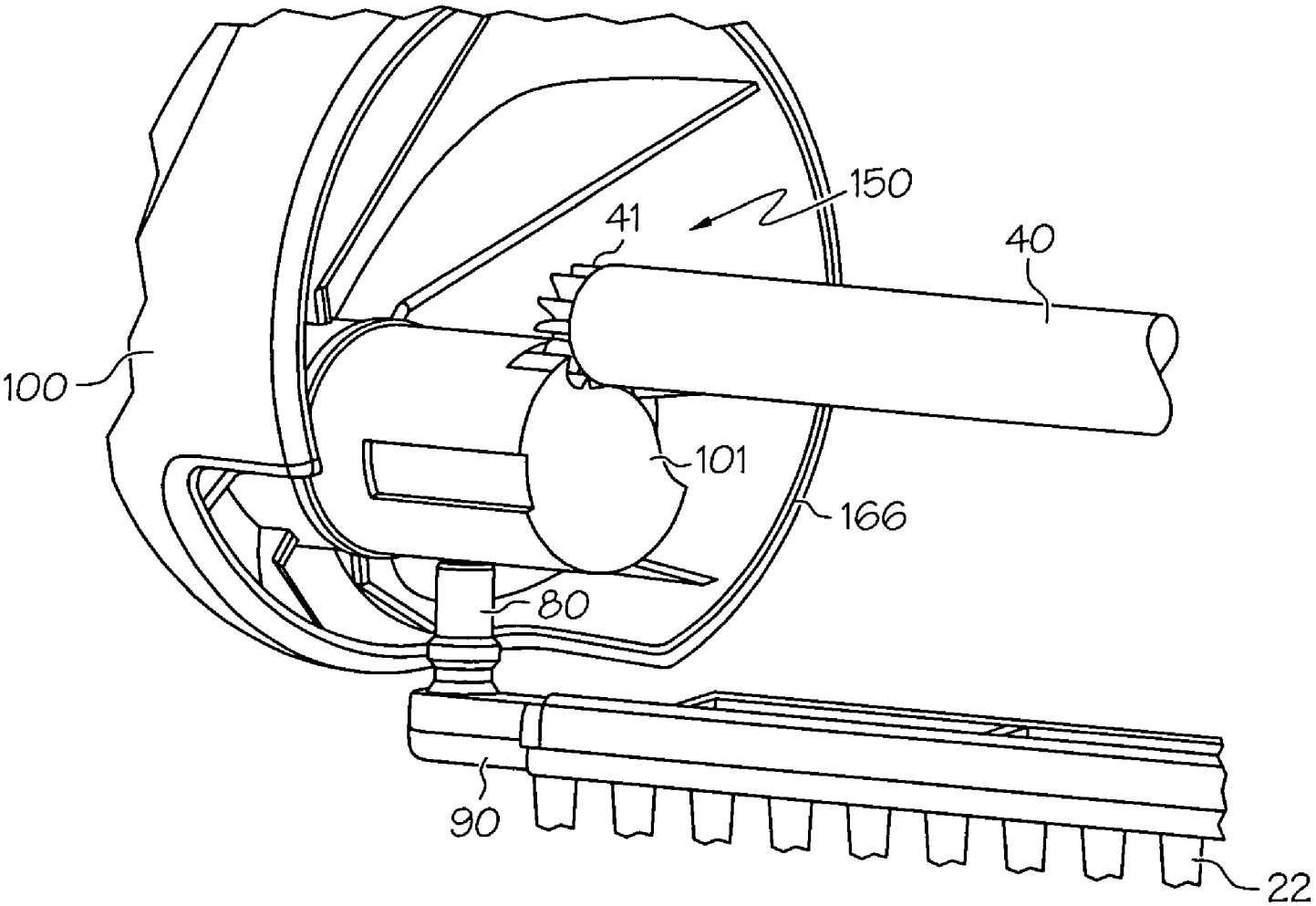
FIG. 9 shows rotational engagement of the screw and portions of the knob, where the cartridge has been removed for clarity.
Figure 10:
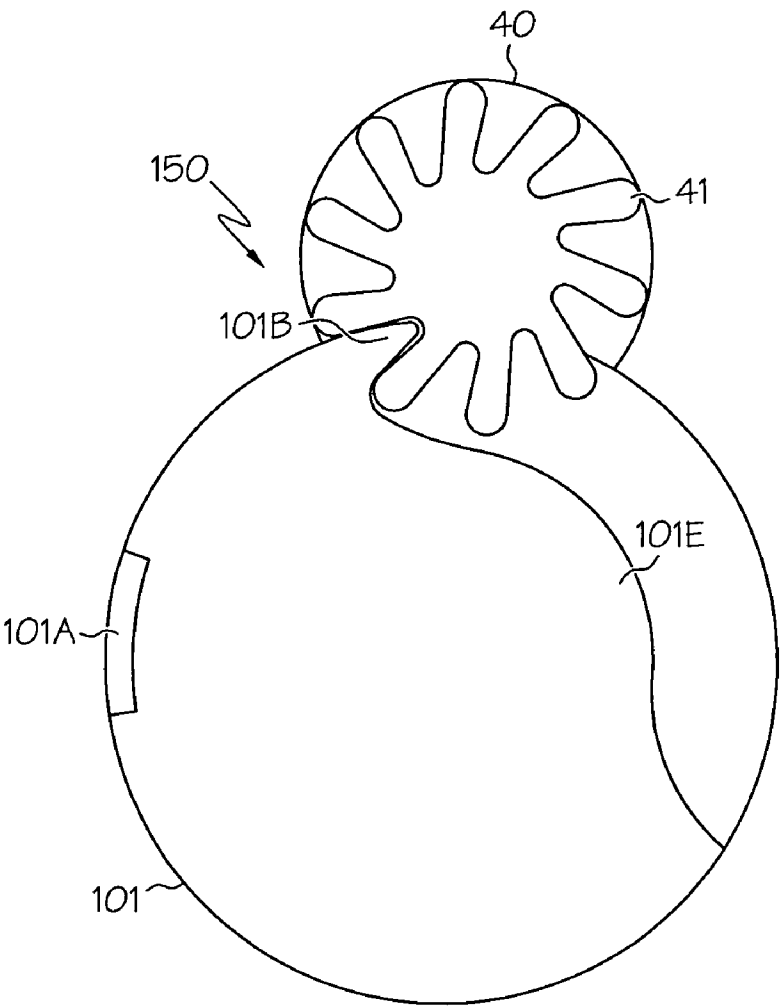
FIG. 10 shows an end view of the locking mechanism showing the gear engaged in a locked position with the stopcock, where other components have been removed for clarity.

Referring next to FIG. 9 in conjunction with FIG. 1, internal views with various components removed for clarity are shown. In the partially distal-looking-proximal view of FIG. 1, the lead screw and piston (both described below as being used to force a fluid from the fluid chamber) are omitted, while in FIG. 9, a partially proximal-looking-distal view shows a geared end 41 of the shaft 40 engaging a complementary surface of stopcock 101 that is presently shown as connected to knob 100, while the cartridge 20 has been removed. Discharge tube 80A, which forms a conduit for discharge aperture 80 maintains fluid coupling between the cartridge and the manifold 90. The manifold 90 is preferably designed to maintain substantially equal flow to each nozzle 22, however, the cartridge 20 of the present invention does not depend on such flow being substantially equal, and may be used with other nozzle configurations to achieve EHD spraying with various characteristics.

While certain representative embodiments and details have been shown for purposes of illustrating the invention, it will be apparent to those skilled in the art that various changes may be made without departing from the scope of the invention, which is defined in the appended claims.

What is claimed is:

1. A fluid dispensing cartridge for use with an electrohydrodynamic spray device, said: cartridge comprising: a fluid chamber with a discharge aperture formed therein; a rotatable shaft disposed in said fluid chamber; a piston threadably responsive to said shaft such that upon rotation thereof, said piston advances to force at least a portion of a fluid disposed in said fluid chamber out said discharge aperture; and a locking mechanism cooperative with said shaft such that in a first position, said locking mechanism engages said shaft to inhibit rotation thereof, while in a second position, said locking mechanism disengages said shaft to permit rotation thereof.

2. The cartridge of claim 1, wherein said shaft comprises a lead screw.

3. The cartridge of claim 1, wherein said cooperation between said locking mechanism and said shaft comprises a rotatable gear formed on one of said locking mechanism and said shaft, and a selectively engageable detent formed on the other of said locking mechanism and said shaft such that in said first position, said detent substantially interferes with said gear to effect said inhibited rotation, while in said second position, said detent substantially does not interfere with said gear to effect said permitted rotation.

4. The cartridge of claim 3, wherein said locking mechanism further comprises a hand-grippable knob coupled to said detent such that upon movement of said knob into a first orientation, said first position is attained, while upon movement of said knob into a second orientation, said second position is attained.

5. The cartridge of claim 4, wherein said cartridge defines a substantially cylindrical profile, and comprises a proximal end where said shaft can engage the spray device and a distal end adjacent said knob, said knob being rotationally cooperative with said shaft such that said movement of said knob is rotational about a longitudinal axis of said cartridge.

6. The cartridge of claim 4, wherein teeth making up said gear define rounded end profiles.

7. The cartridge of claim 6, wherein said detent comprises at least one finger situated on a rotatable member that defines an arcuate gear engagement path, said arcuate gear engagement path and said at least one finger configured to rotate about an axis substantially parallel to said shaft and said piston such that said at least one finger is selectively engageable with said teeth such that said at least one finger fits between adjacent said teeth in said first position to prevent rotation of said gear, and such that it does not fit between adjacent said teeth in said second position to allow rotation of said gear.

8. The cartridge of claim 7, further comprising a stopcock cooperative with said knob and said cartridge such that said stopcock comprises a fluid passageway between said cartridge and the spray device.

9. The cartridge of claim 8, wherein said detent and said rotatable member are formed on said stopcock.

10. The cartridge of claim 7, wherein said arcuate gear engagement path defines a cammed profile that stays in substantial contact with a peripheral dimension of said teeth, said detent extending in a radially outward direction from said cammed profile such that rotational movement between said arcuate gear engagement path and said gear moves said at least one finger into one of said first and second positions.

11. The cartridge of claim 1, wherein said shaft is supported by a race formed at one of a distal end of said fluid chamber or through an axial connection between a distal end of said shaft and said locking mechanism.

12. An electrohydrodynamic spray device comprising the fluid dispensing cartridge of claim 1.

13. The cartridge of claim 1, wherein said locking mechanism comprises a movable locking mechanism.

14. The cartridge of claim 1, wherein said piston does not advance when said locking mechanism is in the first position.

* * * * *